US007287675B1

(12) United States Patent
Sullivan et al.

(10) Patent No.: US 7,287,675 B1
(45) Date of Patent: Oct. 30, 2007

(54) THREE-IN-ONE HEALTH CARE SYSTEM

(76) Inventors: Michael T. Sullivan, 8706 Middle Cross Pl., Tampa, FL (US) 33635; Wayne J. Gullick, 5925 - 20th Ave. S., Gulfport, FL (US) 33707

( * ) Notice: Subject to any disclaimer, the term of this patent is extended or adjusted under 35 U.S.C. 154(b) by 0 days.

(21) Appl. No.: 11/583,576

(22) Filed: Oct. 19, 2006

(51) Int. Cl.
*A47G 25/80* (2006.01)

(52) U.S. Cl. ..... 223/111; 223/118; 223/119; 223/112

(58) Field of Classification Search ..... 223/1, 223/111–119
See application file for complete search history.

(56) References Cited

U.S. PATENT DOCUMENTS 3,806,008 A 4/1974 De Lettre
4,637,533 A * 1/1987 Black ..... 223/112
4,966,316 A 10/1990 George et al.
5,392,800 A * 2/1995 Sergi ..... 135/65
5,687,889 A * 11/1997 Liden ..... 223/111
5,924,610 A * 7/1999 Willemin ..... 223/112
5,961,012 A * 10/1999 Bucher ..... 223/119
6,328,048 B1 * 12/2001 Rivera, Sr. ..... 135/66
6,651,683 B1 11/2003 Hooks et al.
6,694,641 B1 * 2/2004 Gill ..... 36/11.5
6,932,252 B2 8/2005 Simmons
6,942,129 B2 9/2005 Ferraioli
2004/0255995 A1 * 12/2004 Garrett ..... 135/66

* cited by examiner

*Primary Examiner*—Gary L. Welch
*Assistant Examiner*—Andrew W Sutton
(74) *Attorney, Agent, or Firm*—Edward P. Dutkiewicz

(57) ABSTRACT

A reacher has a near end with a handle and a trigger. A reacher has a far end. An intermediate extent is provided between the near end and the far end. A sock aide is removably coupled to the reacher adjacent to the far end. A shoe horn is slidably supported on the reacher adjacent to the far end.

3 Claims, 5 Drawing Sheets

FIG 3
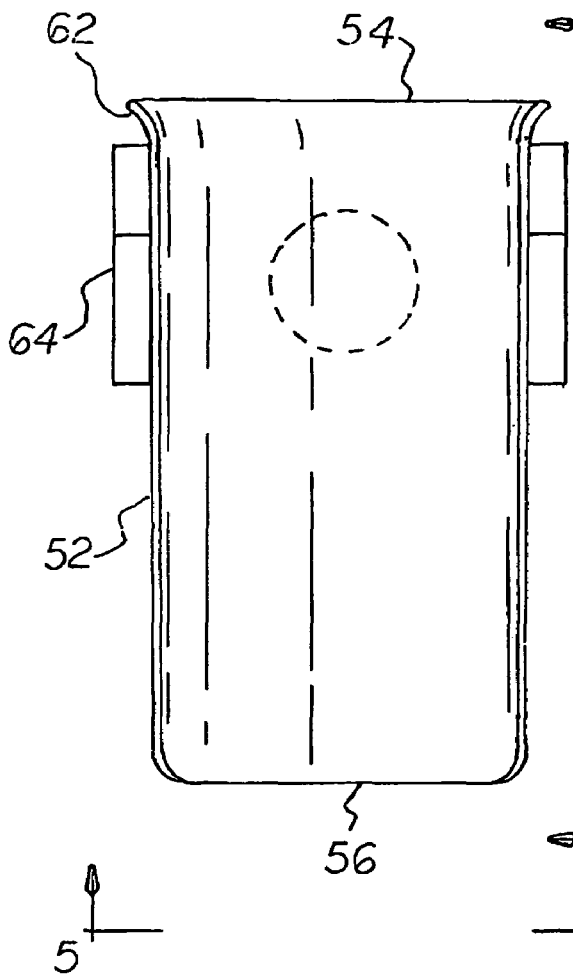
FIG 4
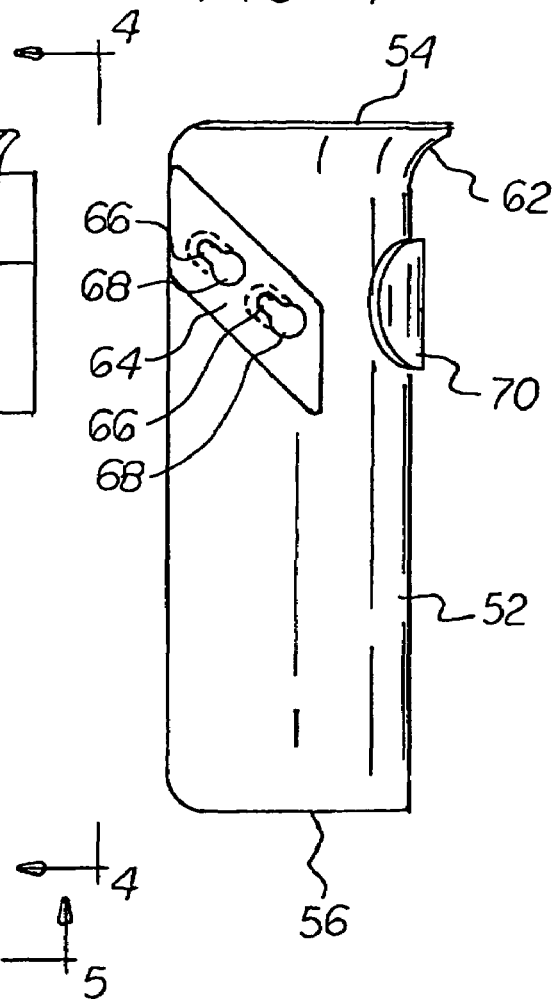
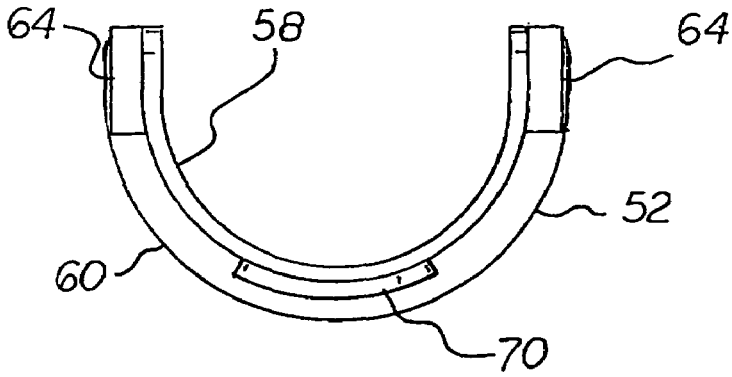
FIG 5

THREE-IN-ONE HEALTH CARE SYSTEM

BACKGROUND OF THE INVENTION

1. Field of the Invention

The present invention relates to a three-in-one health care system and more particularly pertains to assisting physically challenged people to put on and remove shoes and socks.

2. Description of the Prior Art

The use of health care aides of known designs and configurations is known in the prior art. More specifically, health care aides of known designs and configurations previously devised and utilized for the purpose of assisting physically challenged people through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,806,008 issued Apr. 23, 1974 to De Lettre relates to a Tool for Putting Socks on Feet. U.S. Pat. No. 4,966,316 issued Oct. 30, 1990 to George relates to a Shoe Horn and Cane Apparatus. U.S. Pat. No. 5,392,800 issued Feb. 28, 1995 to Sergi relates to a Multi-Purpose Cane Device. U.S. Pat. No. 6,651,683 issued Nov. 25, 2003 to Hooks relates to a Method for Carrying a Reacher on a Walker and Apparatus Therefor. U.S. Pat. No. 6,942,129 issued Sep. 13, 2005 to Ferrailoi relates to a Footwear Donning Device. Lastly, U.S. Pat. No. 6,932,252 issued Aug. 23, 2005 to Simmons relates to a Device to Allow Physically Limited Persons to Put on or Remove Socks.

While these devices fulfill their respective, particular objectives and requirements, the aforementioned patents do not describe a three-in-one health care system that allows assisting physically challenged people to put on and remove shoes and socks.

In this respect, the three-in-one health care system according to the present invention substantially departs from the conventional concepts and designs of the prior art, and in doing so provides an apparatus primarily developed for the purpose of assisting physically challenged people to put on and remove shoes and socks.

Therefore, it can be appreciated that there exists a continuing need for a new and improved three-in-one health care system which can be used for assisting physically challenged people to put on and remove shoes and socks. In this regard, the present invention substantially fulfills this need.

SUMMARY OF THE INVENTION

In view of the foregoing disadvantages inherent in the known types of health care aides of known designs and configurations now present in the prior art, the present invention provides an improved three-in-one health care system. As such, the general purpose of the present invention, which will be described subsequently in greater detail, is to provide a new and improved three-in-one health care system and method which has all the advantages of the prior art and none of the disadvantages.

To attain this, the present invention essentially comprises a three-in-one health care system. First provided is a reacher. The reacher has a linear shaft. The linear shaft has a linear axis. The shaft has a near end and a far end. The shaft has an upper face and an essentially parallel lower face. Parallel side faces are provided between the upper and lower faces.

The near end is formed with a fixed handle and a pivotable trigger. The fixed handle and trigger extend from the lower face. The far end is formed with a fixed support and a reciprocating support. The fixed support and reciprocating support extend from the lower face. The fixed and reciprocable supports have elastomeric ends for grasping socks and like objects. A flexible line is provided. The flexible line has a spring. The spring couples the trigger. The reciprocating support resiliently urges the supports apart away from a gripping relationship. In this manner, when the trigger is pulled rearwardly toward the handle, the line retracted and moves the reciprocating support toward the fixed support.

Two parallel primary pins are provided. The primary pins have enlarged heads. The pins extend laterally from each side face of the shaft spaced along the axis. The pins are positioned adjacent to the far end. Two parallel knurled bolts are provided. The bolts have enlarged heads. The bolts are threadedly received in the top face of the shaft spaced along the axis. The bolts are positioned adjacent to the far end. The fixed and reciprocable supports are adapted to be moved together to grip and raise socks by pulling the trigger and to be moved apart to release socks by releasing the trigger.

A sock aide is provided. The sock aide is fabricated of an essentially rigid plastic material. The sock aide is provided in a semi-cylindrical configuration. The sock aide has an upper end and a lower end. The sock aide has an interior surface and an exterior surface. The interior and exterior surfaces are between the upper and lower ends. An outwardly flared edge is provided at the upper end of the sock aide. In this manner limit the movement of a sock is provided and the entry of a foot of a user into a sock supported in the sock aide is facilitated. Supplemental supports are provided on each side of the exterior surface adjacent to the upper end. The supplemental supports have aligned slots. The supplemental supports have enlarged ends for receiving and supporting the primary pins on either side face during operation and use. An elastomeric disk in the sock aid abates undesired slipping of a sock with respect to the sock aid.

Further provided is a shoe horn. The shoe horn is fabricated of an essentially rigid plastic material. The shoe horn is in an arcuate cross sectional configuration. The shoe horn has a first end. The first end is provided adjacent to the near end of the reacher. The shoe horn has a second end. The second end is curved and is formed adjacent to the far end of the reacher. The shoe horn has an interior surface and an exterior surface. The interior and exterior surfaces are provided between the first and second ends. The shoe horn has a length less than the length of the reacher. The shoe horn has an axis. The axis of the shoe horn is parallel with the axis of the reacher. An elongated slot is provided. The elongated slot is formed along the length of the shoe horn. The elongated slot receives the knurled bolts during operation and use. The knurled bolts are adapted to be loosened to allow shifting of the shoe horn and adapted to be tightened with the first end beneath the lower end of the reacher for operation and use and above the lower end of the reacher for storage.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved three-in-one health care system which has all of the advantages of the prior art health care aides of known designs and configurations and none of the disadvantages.

It is another object of the present invention to provide a new and improved three-in-one health care system which may be easily and efficiently manufactured and marketed.

It is further object of the present invention to provide a new and improved three-in-one health care system which is of durable and reliable constructions.

An even further object of the present invention is to provide a new and improved three-in-one health care system which is susceptible of a low cost of manufacture with regard to both materials and labor, and which accordingly is then susceptible of low prices of sale to the consuming public, thereby making such three-in-one health care system economically available to the buying public.

Even still another object of the present invention is to provide a three-in-one health care system for assisting physically challenged people to put on and remove shoes and socks.

Lastly, it is an object of the present invention to provide a new and improved three-in-one health care system. A reacher has a near end with a handle and a trigger. A reacher has a far end. An intermediate extent is provided between the near end and the far end. A sock aide is removably coupled to the reacher adjacent to the far end. A shoe horn is slidably supported on the reacher adjacent to the far end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the sock aide shown in FIGS. 1 and 2.

FIG. 4 is a front elevational view of the sock aide taken along line 4-4 of FIG. 3.

FIG. 5 is a plan view of the sock aide taken along line 5-5 of FIG. 3.

The same reference numerals refer to the same parts throughout the various Figures.

DESCRIPTION OF THE PREFERRED EMBODIMENT

Figure 1:
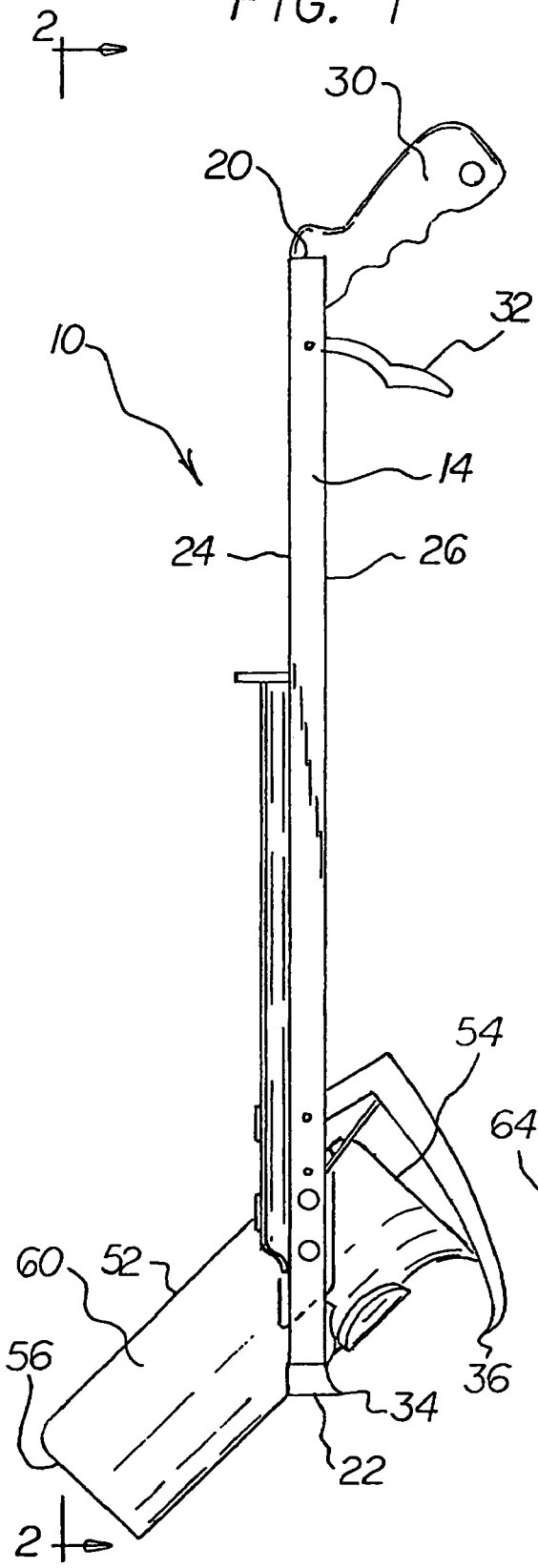
FIG. 1 is a side elevational view of a three-in-one health care system constructed in accordance with the principles of the present invention.
Figure 2:
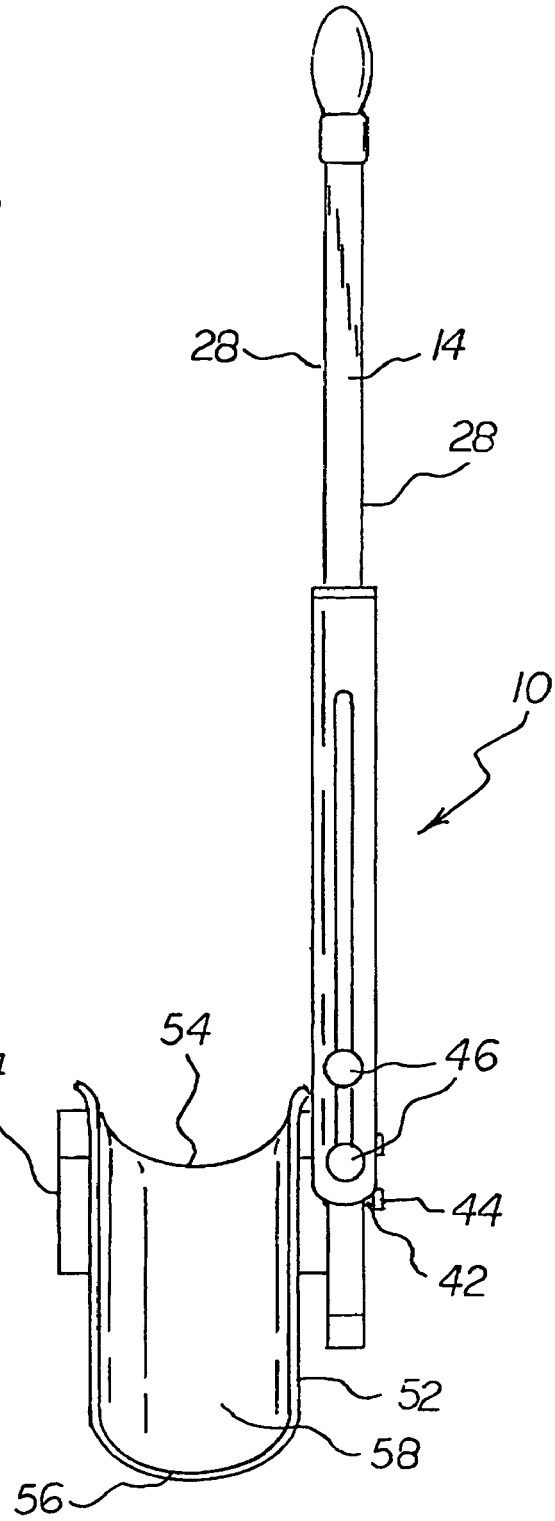
FIG. 2 is a front elevational view of the system taken along line 2-2 of FIG. 1.
Figure 6:
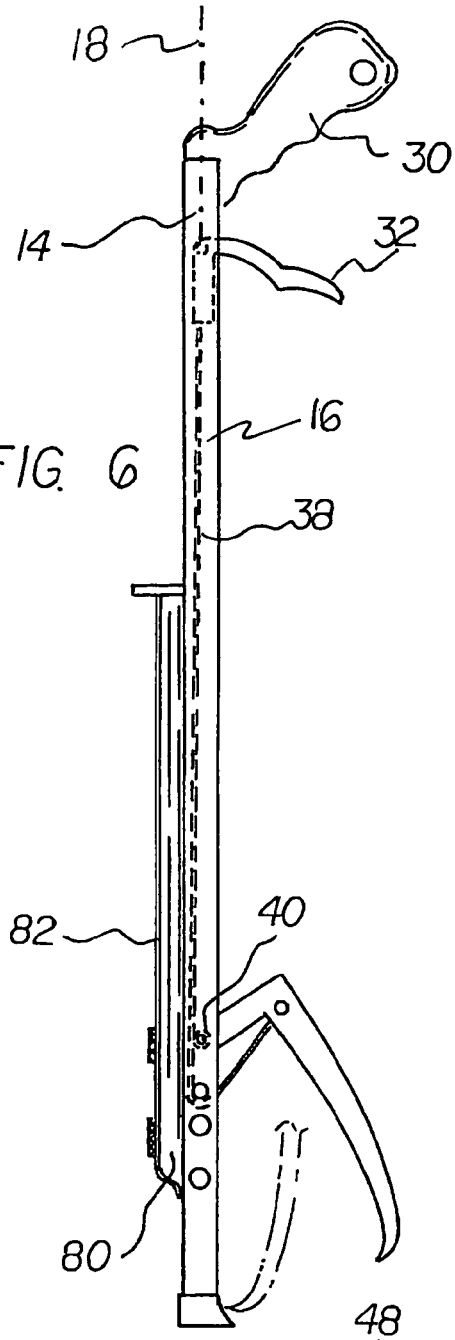
FIG. 6 is a side elevational view of the reacher shown in FIGS. 1 and 2.
Figure 7:
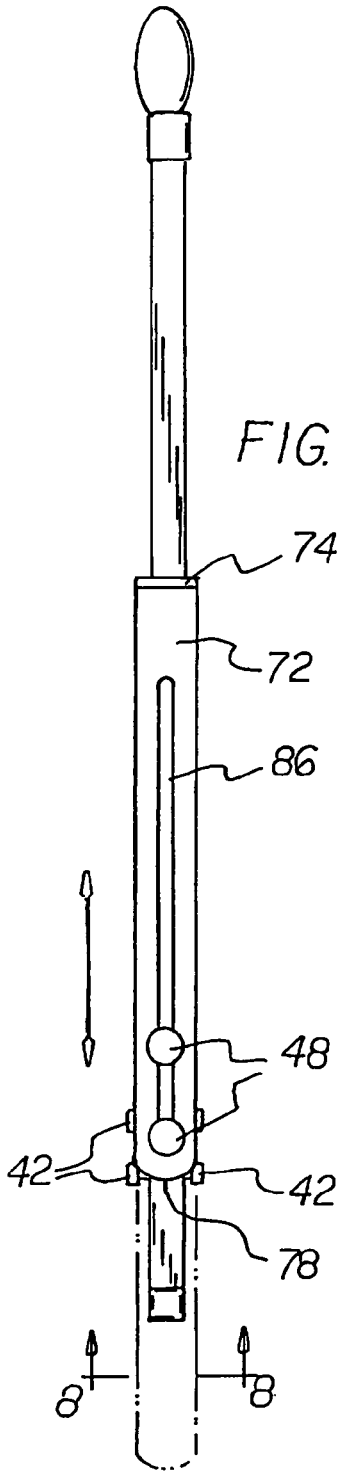
FIG. 7 is a front elevational view of the reacher taken along line 8-8 of FIG. 6.

With reference now to the drawings, and in particular to FIG. 1 thereof, the preferred embodiment of the new and improved three-in-one health care system embodying the principles and concepts of the present invention and generally designated by the reference numeral 10 will be described.

The present invention, the three-in-one health care system 10 is comprised of a plurality of components. Such components in their broadest context include a reacher, a sock aide and a shoe horn. Such components are individually configured and correlated with respect to each other so as to attain the desired objective.

First provided is a reacher 14. The reacher has a linear shaft 16. The linear shaft has a linear axis 18. The shaft has a near end 20 and a far end 22. The shaft has an upper face 24 and an essentially parallel lower face 26. Parallel side faces 28 are provided between the upper and lower faces. The near end is formed with a fixed handle 30 and a pivotable trigger 32. The fixed handle and trigger extend from the lower face. The far end is formed with a fixed support 34 and a reciprocating support 36. The fixed support and reciprocating support extend from the lower face. The fixed and reciprocable supports have elastomeric ends for grasping socks and like objects. A flexible line 38 is provided. The flexible line has a spring 40. The spring couples the trigger. The reciprocating support resiliently urges the supports apart away from a gripping relationship. In this manner, when the trigger is pulled rearwardly toward the handle, the line retracted and moves the reciprocating support toward the fixed support.

Figure 8:
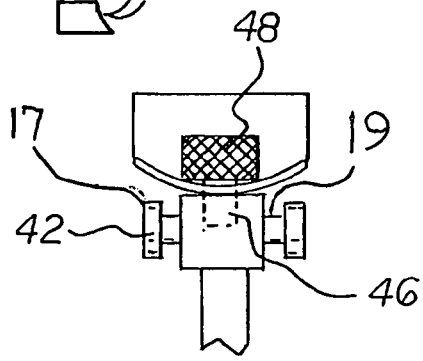
FIG. 8 is a plan view of the sock aide taken along line 8-8 of FIG. 7.
Figure 9:
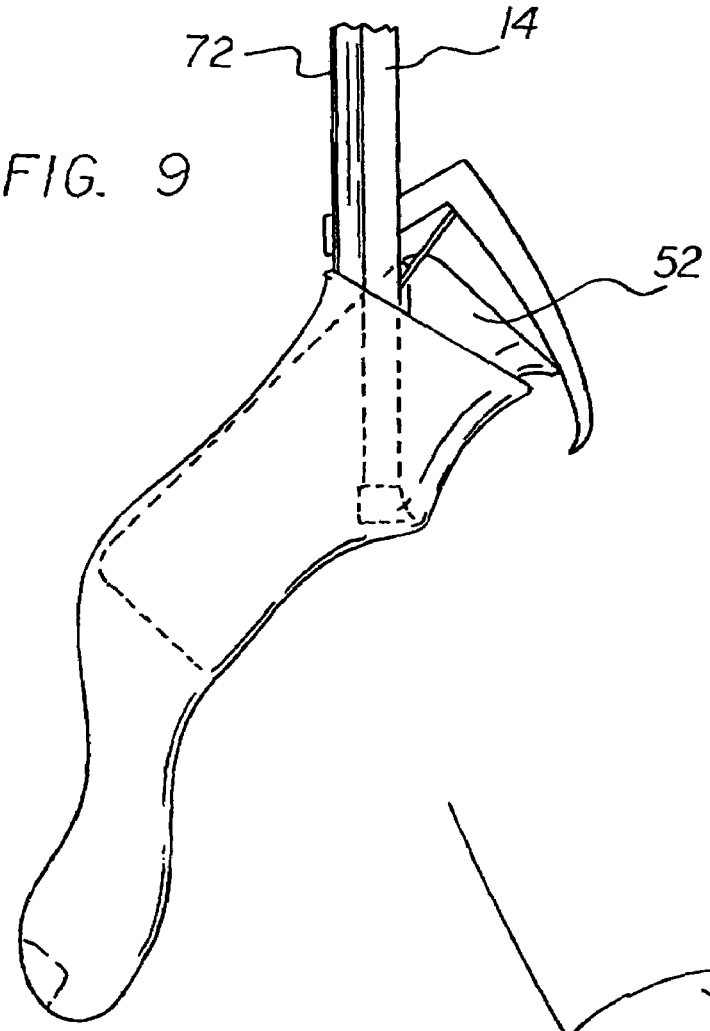
FIG. 9 is a side elevational view of the sock aide supporting a sock to be donned.
Figure 10:
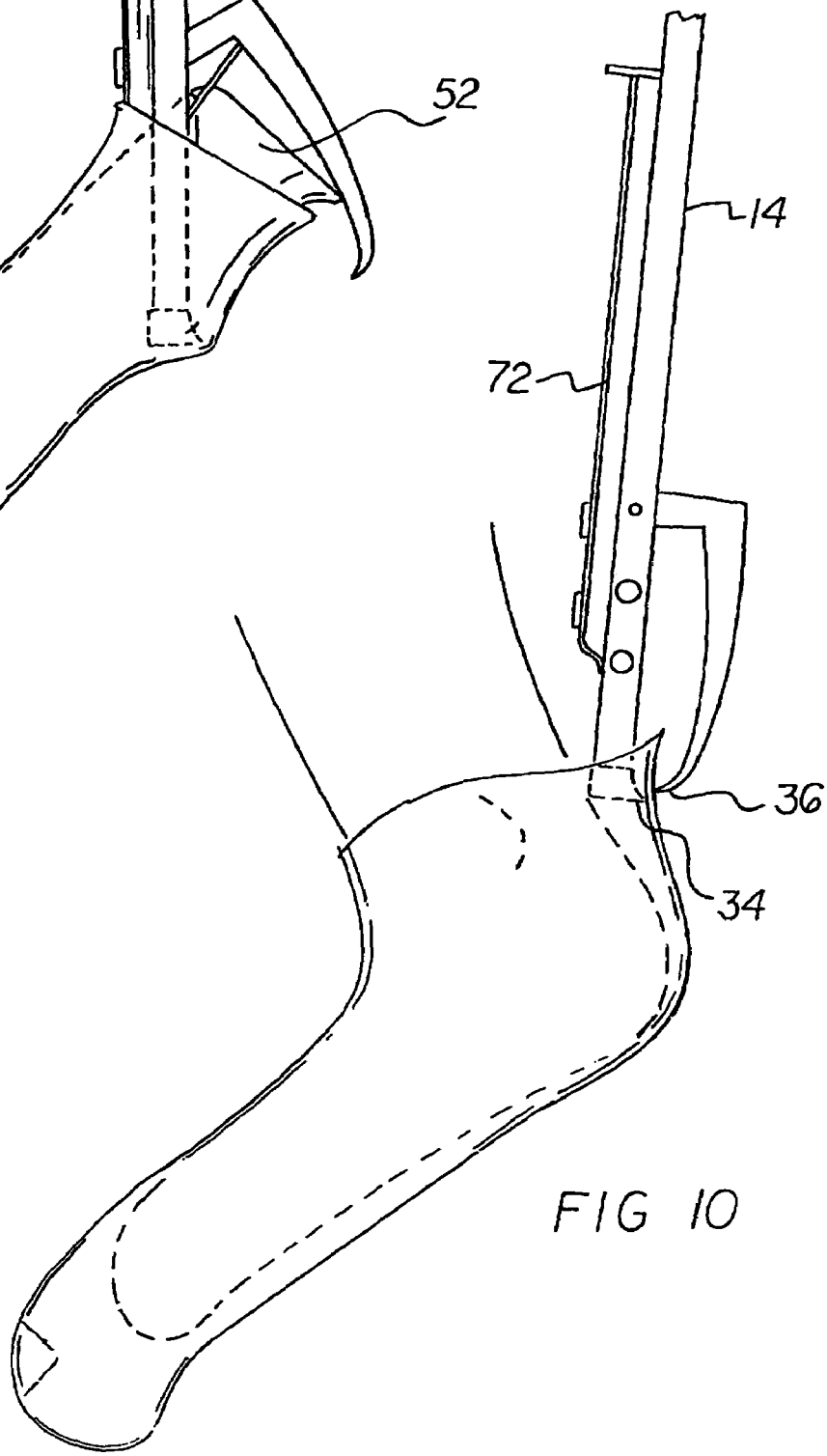
FIG. 10 is a side elevational view of the reacher supporting pulling up a sock to be worn.

Two parallel primary pins 42 are provided. The primary pins have enlarged T-shaped heads 44. The enlarged T-shaped head has a width 17. As can be seen in FIG. 8, each of the pins has, between the enlarged head 44 and the shaft 16, a space 19. The space is sized to allow the T-shaped head to be received by and mated with slot 68. The space has a width approximating the width of the enlargement of the head. The pins extend laterally from each side face of the shaft spaced along the axis. The pins are positioned adjacent to the far end. Two parallel knurled bolts 46 are provided. The bolts have enlarged heads 48. The bolts are threadedly received in the top face of the shaft spaced along the axis.

The bolts are positioned adjacent to the far end. The fixed and reciprocable supports are adapted to be moved together to grip and raise socks by pulling the trigger and to be moved apart to release socks by releasing the trigger.

A sock aide 52 is provided. The sock aide is fabricated of an essentially rigid plastic material. The sock aide is provided in a semi-cylindrical configuration. The sock aide has an upper end 54 and a lower end 56. The sock aide has an interior surface 58 and an exterior surface 60. The interior and exterior surfaces are between the upper and lower ends. An outwardly flared edge 62 is provided at the upper end of the sock aide. In this manner limit the movement of a sock is provided and the entry of a foot of a user into a sock supported in the sock aide is facilitated. Supplemental supports 64 are provided on each side of the exterior surface adjacent to the upper end. The supplemental supports have aligned slots 66. The supplemental supports have enlarged ends 68 for receiving and supporting the primary pins on either side face during operation and use. An elastomeric disk 70 is inserted in the sock aid which abates undesired slipping of a sock with respect to the sock aid.

Further provided is a shoe horn 72. The shoe horn is fabricated of an essentially rigid plastic material. The shoe horn is in an arcuate cross sectional configuration. The shoe horn has a first end 74. The first end is provided adjacent to the near end of the reacher 76. The shoe horn has a second end 78. The second end is curved and is formed adjacent to the far end of the reacher. The shoe horn has an interior surface 80 and an exterior surface 82. The interior and exterior surfaces are provided between the first and second ends. The shoe horn has a length less than the length of the reacher. The shoe horn has an axis 84. The axis of the shoe horn is parallel with the axis of the reacher. A single uniform elongated slot 86 is provided. The elongated slot is formed along the length of, and in, the shoe horn. The elongated slot receives the knurled bolts during operation and use. The knurled bolts are adapted to be loosened to allow shifting of the shoe horn and adapted to be tightened with the first end beneath the lower end of the reacher for operation and use and above the lower end of the reacher for storage.

Figure 11:
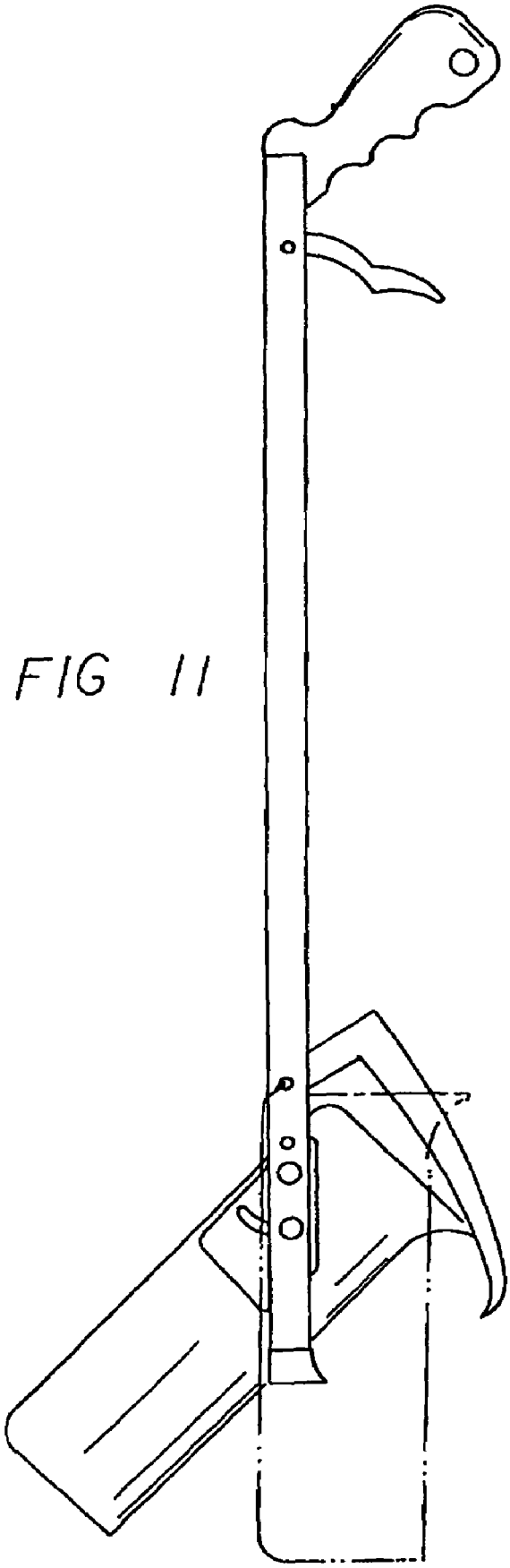
FIGS. 11 and 12 are side elevational views, similar to FIGS. 1 and 4, of a sock aide illustrating an alternate embodiment of the invention.
Figure 12:
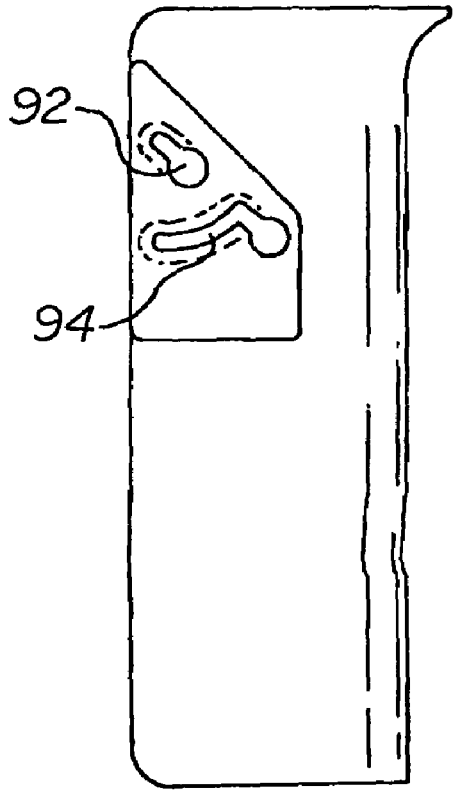

FIGS. 11 and 12 are side elevational views, similar to FIGS. 1 and 4, of a sock aide illustrating an alternate embodiment of the invention. In such alternate embodiment, the slots on each side of the sock aide include an upper slot 92 for the upper enlarged head of the reacher and a curved slot 94 for the lower enlarged head of the reacher. In this manner, the angle of the sock aide with respect to the reacher is adapted to be varied for greater convenience to the user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A three-in-one health care system comprising:

a reacher having a near end with a handle and a trigger and a far end with an intermediate end there between, the reacher having parallel primary pins with enlarged T-shaped heads forming a space between the enlargement of the head and the shaft, a sock aide removably coupled to the reacher primary pins adjacent to the far end, the sock aide having a semi-cylindrical configuration with an upper end and a lower end and with an interior surface and an exterior surface between the upper and lower ends, an outwardly flared edge at the upper end of the sock aide to limit the movement of a sock there above and to facilitate the entry of a foot of a user into a sock supported in the sock aide, supplemental supports on the exterior surface adjacent to the upper end, the supplemental supports having aligned slots with enlarged ends for removably receiving and supporting the primary pins on either side face during operation and use; and a shoe horn slidably supported on the reacher adjacent to the far end, the shoe horn having an arcuate cross sectional configuration with a first end adjacent to the near end of the reacher and a second end adjacent to the far end of the reacher and with an interior surface and an exterior surface between the first and second ends, the shoe horn having a length less than the length of the reacher and an axis parallel with the axis of the reacher, a single uniform elongated slot parallel with the axis of the reacher formed in the shoe horn for receiving the knurled bolts during operation and use.

2. The system as set forth in claim 1 and further including an elastomeric disk in the sock aid adapted to abate undesired slipping of a sock with respect to the sock aid.

3. A three-in-one health care system for assisting physically challenged people to put on and remove shoes and socks comprising, in combination:

a reacher having a linear shaft, the linear shaft having a linear axis with a near end and a far end, the shaft having an upper face and an essentially parallel lower face with parallel side faces there between, the near end being formed with a fixed handle and a pivotable trigger extending from the lower face, the far end being formed with a fixed support and a reciprocating support extending from the lower face, the fixed and reciprocable supports having elastomeric ends for grasping socks and like objects a flexible line with a spring coupling the trigger and the reciprocating support resiliently urging the supports apart away from a gripping relationship whereby pulling the trigger rearwardly toward the handle will retract the line and move the reciprocating support toward the fixed support, two parallel primary pins with enlarged heads extending laterally from each side face of the shaft spaced along the axis and positioned adjacent to the far end, the primary pins having forming a space between the enlarged head of the pin and the shaft, two parallel knurled bolts with enlarged heads threadedly received in the top face of the shaft spaced along the axis and positioned adjacent to the far end, the fixed and reciprocable supports adapted to be moved together to grip and raise socks by pulling the trigger and to be moved apart to release socks by releasing the trigger;

a sock aide fabricated of an essentially rigid plastic material in a semi-cylindrical configuration with an upper end and a lower end and with an interior surface and an exterior surface between the upper and lower ends, an outwardly flared edge at the upper end of the sock aide to limit the movement of a sock there above and to facilitate the entry of a foot of a user into a sock supported in the sock aide, supplemental supports on the exterior surface adjacent to the upper end, the supplemental supports having slots with enlarged ends for removably receiving and supporting the primary pins on either side face during operation and use, the slots including an upper slot and a lower slot in an arcuate configuration for varying the orientation of the sock aide with respect to the linear shaft; and a shoe horn fabricated of an essentially rigid plastic material in an arcuate cross sectional configuration with a first end adjacent to the near end of the reacher and a second end adjacent to the far end of the reacher and with an interior surface and an exterior surface between the first and second ends, the shoe horn having a length less than the length of the reacher and an axis parallel with the axis of the reacher, a single uniform elongated slot formed in the shoe horn for receiving the knurled bolts during operation and use, the knurled bolts adapted to be loosened to allow shifting of the shoe horn and adapted to be tightened with the first end beneath the lower end of the reacher for operation and use and above the lower end of the reacher for storage.

* * * * *